US007533878B2

(12) United States Patent
Cook et al.

(10) Patent No.: US 7,533,878 B2
(45) **Date of Patent: *May 19, 2009**

(54) PRINTER MEDIA TRANSPORT FOR VARIABLE LENGTH MEDIA

(75) Inventors: Brian Dale Cook, Nicholasville, KY (US); William Scott Klein, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 467 days.

This patent is subject to a terminal disclaimer.

(21) Appl. No.: 10/865,632

(22) Filed: Jun. 10, 2004

(65) Prior Publication Data

US 2005/0275150 A1 Dec. 15, 2005

(51) Int. Cl.
*B65H 3/06* (2006.01)

(52) U.S. Cl. ..... 271/114; 271/10.11; 271/10.09; 271/273

(58) Field of Classification Search ..... 271/8.1, 271/109, 273, 228, 117, 118, 10.11
See application file for complete search history.

(56) References Cited

U.S. PATENT DOCUMENTS 3,937,455 A * 2/1976 Hauser ..... 271/122
4,834,568 A 5/1989 Kagami et al.
4,986,525 A 1/1991 Takagi et al.
5,120,042 A * 6/1992 Goto et al. ..... 271/117
5,123,637 A * 6/1992 Musaka ..... 271/117
5,645,273 A * 7/1997 Nakagawa et al. ..... 271/10.1
6,042,109 A * 3/2000 Klausbruckner ..... 271/225
6,304,731 B1 * 10/2001 Able et al. ..... 399/45
6,352,256 B1 * 3/2002 Hsieh ..... 271/110
6,375,183 B1 * 4/2002 Inoue et al. ..... 271/10.11
6,929,261 B2 * 8/2005 Nelson et al. ..... 271/273
7,093,830 B2 * 8/2006 Kang ..... 271/118
7,121,546 B2 * 10/2006 Johnson et al. ..... 271/273
2003/0067108 A1 * 4/2003 Marra et al. ..... 271/10.01
2003/0202813 A1 * 10/2003 Schoedinger ..... 399/69
2004/0070136 A1 * 4/2004 Chung ..... 271/117
2004/0245704 A1 * 12/2004 Hall et al. ..... 271/117

OTHER PUBLICATIONS

U.S. Appl. No. 10/879,873 Commonly Owned.

* cited by examiner

*Primary Examiner*—Patrick H Mackey
*Assistant Examiner*—Kalyanavenkateshware Kumar
(74) *Attorney, Agent, or Firm*—King & Schickli, PLLC

(57) ABSTRACT

Printer (1) has a pivotally mounted autocompensating system (19) mounted at an intermediate position in paper guide (17). That system (19) is driven by a motor (40)through a slip drive (70, 72, 74). The motor also drives paper feed system (15). When the motor turns in a direction to feed by system (15), the intermediate system is moved away from the paper guide. When a sheet reaches a position to be fed by the intermediate system, the motor is reversed, and the intermediate system pivots against the paper for moving it further through the paper guide.

6 Claims, 7 Drawing Sheets

PRINTER MEDIA TRANSPORT FOR VARIABLE LENGTH MEDIA

TECHNICAL FIELD

This invention relates to imaging devices that feed variable length media over a paper path longer than the length of some of the media to be fed.

BACKGROUND OF THE INVENTION

Printing devices utilizing a media tray under the device typically feed the media out of the tray to the rear and around a "C" shaped path to enter the imaging area and exit to the front of the device. This provides a very compact machine. Because of the varying lengths of media fed through such a device, some mechanism must be provided to accommodate the discrepancy between the length of short media and the path length. This conventionally is done by using a relatively large drive roller (or rollers) which move the media toward non-driven idler rollers to maintain contact with the media while it is being fed around the path and into the imaging area.

DISCLOSURE OF THE INVENTION

This invention employs in an intermediate location in the feed path a drive system which has been used successfully as the initial media pick-and-feed system from the tray. That mechanism is an autocompensting system, comprising one or more feed rollers on a swing arm pivoted around a gear train which drives the feed roller. Autocompensating systems are cost-effective and may be moved toward the media for feeding and off the media by reversing the torque to the gear train. An autocompensating system is also used to pick paper from the tray, and both autocompensating systems may be driven from one motor through different drive trains.

The intermediate autocompensating system is moved away from the feed path until media is driven past that system. Then that system is applied to move the media while the tray autocompensating system is not driven.

BRIEF DESCRIPTION OF THE DRAWINGS

The details of this invention will be described in connection with the accompanying drawings, in which.

DESCRIPTION OF THE PREFERRED EMBODIMENTS

Figure 1:
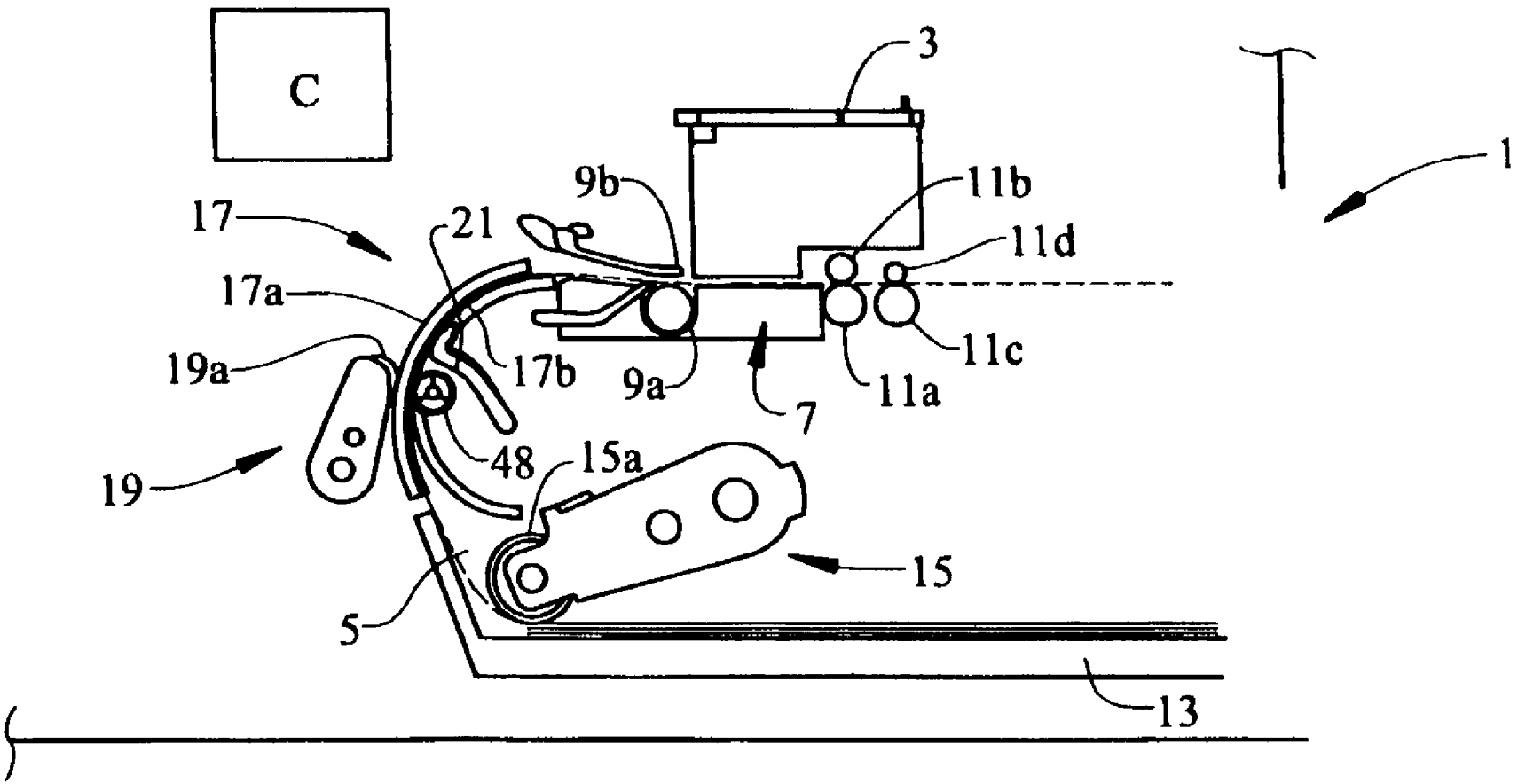
FIG. 1 is a printer and is illustrative of a long, C-shaped path between a paper tray and the imaging printhead.

FIG. 1 is illustrative of a printer 1 with specific elements pertinent to this invention. Printer 1 may be a standard inkjet printer in most respects. As such it has a bottle printhead 3 which jets dots of ink through nozzles not shown, which are located above a sheet 5 of paper or other media at a imaging station 7

Imaging station 7 is located past nip rollers 9*a*, 9*b* which grasp paper 5 in the nip of rollers 9*a*, 9*b* and move it under printhead 3. Nip rollers 9*a*, 9*b* are stopped normally several times to permit printhead 3 to partially image sheet 5 by moving across sheet 5 (in and out of the view of FIG. 1) while expelling dots in the desired pattern. In a draft mode the number of such intermittent stops may be only two, while in a quality mode that number may be five or more.

Nip rollers 9*a*, 9*b* push paper through the imaging station 7 where they enter exits rollers 11*a*, 11*b*, 11*c*, and 11*d*. Although rollers are by far the most common mechanism to transport the imaged sheet 5 out of the printer 1 to the user of the printer 1, virtually any grasping device can be used, such as a belt and pressing device or pneumatic suction device.

The printer of FIG. 1 has a paper tray 13 located on the bottom. Tray 13 constitutes a bin in which a stack of paper or other media sheets 5 are held to be imaged. Having tray 13 located on the bottom of printer 1 permits a large stack of sheets 5 to be in the printer 1. This spaces the tray 13 from the print stations 7, the distance from pick roller 15*a* of tray 13 to nip rollers 9*a*, 9*b* being longer than the length of some media sheets 5 to be printed. Pick roller 15*a* is a part of an autocompensating swing mounted system 15.

A C-shaped paper guide 17 is made up of rear guide surface 17*a* and spaced, generally parallel, front guide surface 17*b*. Both surfaces have spaced ridges (shown for surface 17*b* as 17*bb* in FIG. 2), as is common. Guide 17 directs a sheet 5 to nip rollers 9*a*, 9*b*. Intermediate in guide 17 is drive roller 19*a*, which is a part of an autocompensating swing-mounted system 19. Sensor arm 21 is moved by a sheet 5 to detect the sheet 5 at system 19.

Pick roller 15*a* at tray 13 and drive roller 19*a* combine to move sheets 5 from tray 13 to nip rollers 9*a*, 9*b*. Drive roller 19*a* is effective to move short media into rollers 9*a*, 9*b*, when pick roller 15*a* is no longer in contact with the sheet 5.

Operational control is by electronic data processing apparatus, shown as element C in FIG. 1. Such control is now entirely standard. A standard microprocessor may be employed, although an Application Specific Integrated Circuit (commonly known as an ASIC) is also employed, which is essentially a special purpose computer, the purpose being to control all actions and timing of printer 1. Electronic control is so efficient and versatile that mechanical control by cams and relays and the like is virtually unknown in imaging. However, such control is not inconsistent with this invention.

Figure 2:
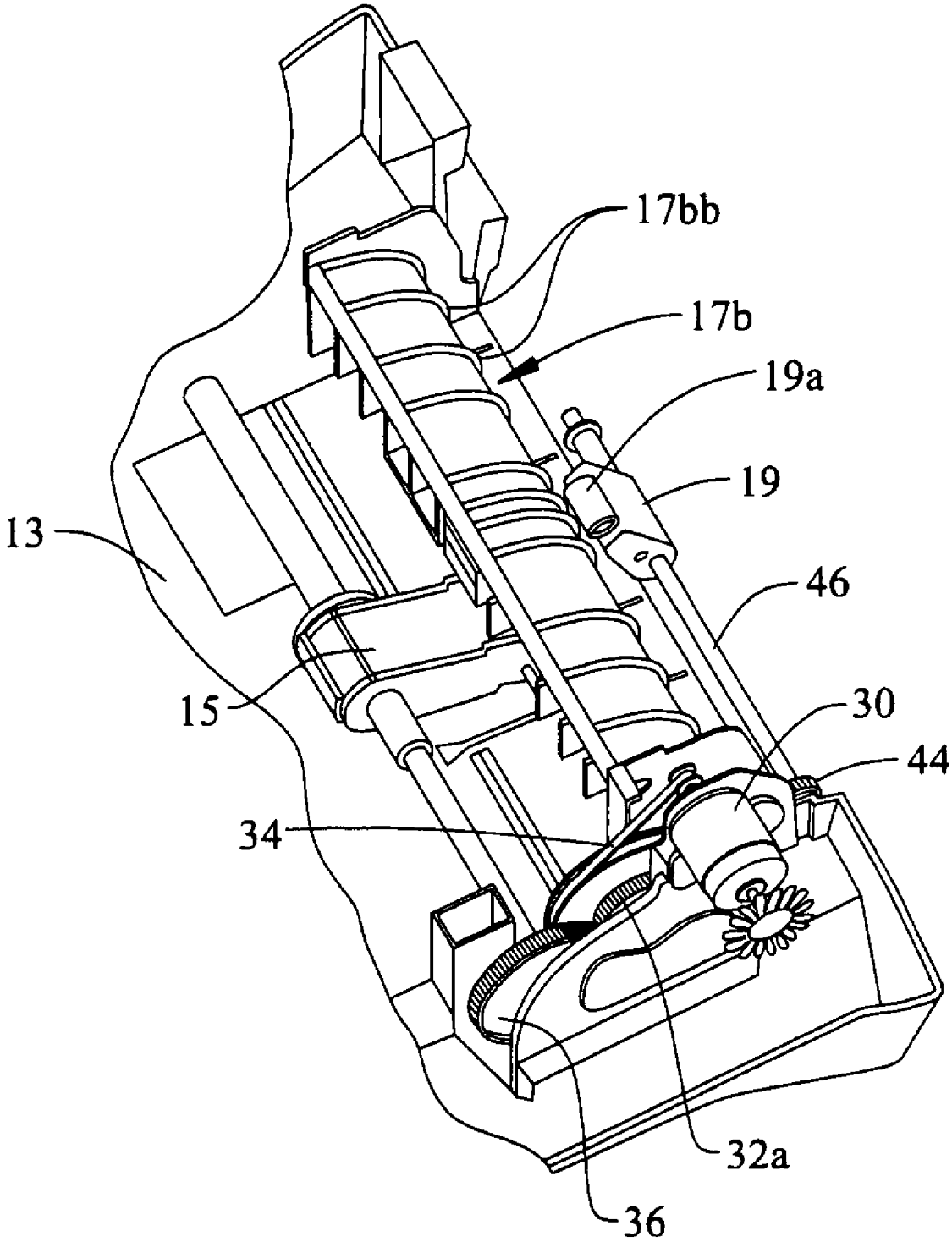
FIG. 2 is a partial, somewhat more detailed, perspective view downward on the tray and the front guide.
Figure 3:
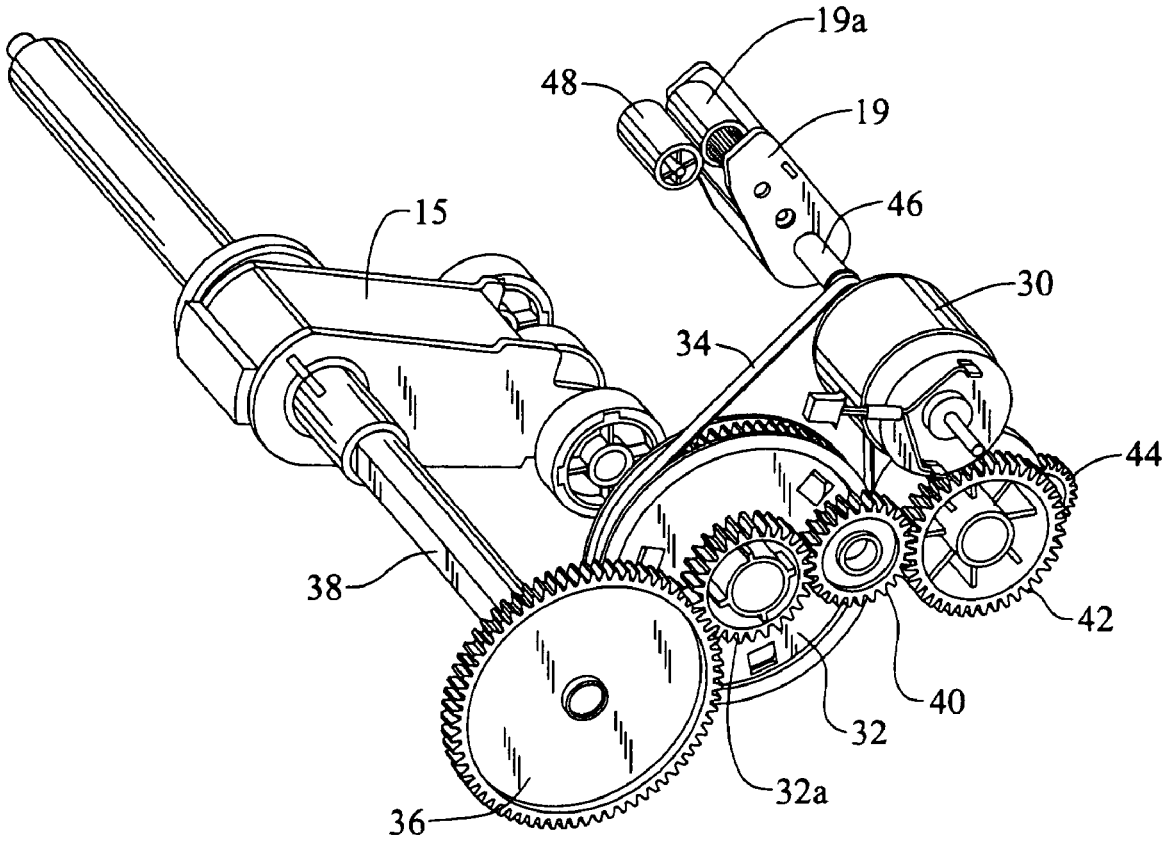
FIG. 3 is a view from the same side as the view of FIG. 2 of the motor and gear train to the autocompensating systems.
Figure 4:
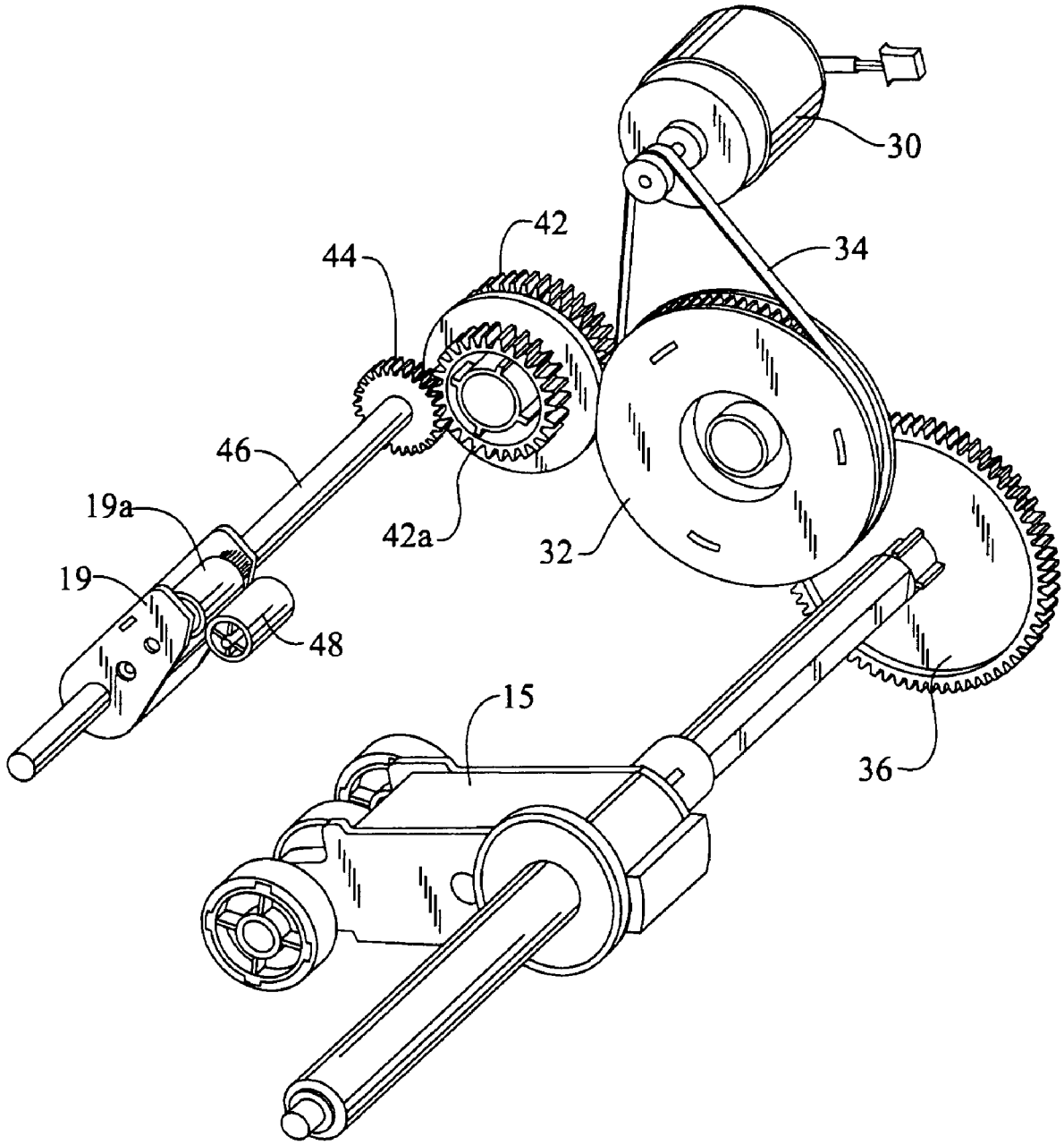
FIG. 4 is a view from the side opposite the view of FIG. 2 of motor and gear trains to the autocompensating systems.

Movement of parts in the printer shown in FIGS. 2, 3 and 4 is by one motor. With respect to FIG. 3 motor 30 is seen to drive a large gear 32 through a belt 34. Gear 32 has integral with it a central, smaller gear 32*a*. The gear 32 is meshed with large gear 36, which is integral with shaft 38 to provide torque to autocompensating system 15.

Similarly, gear 32*a* meshes with idler gear 40 which meshes with a somewhat larger gear 42. Gear 42 has integral with it a central, smaller gear 42*a* (best seen in FIG. 4). Gear 42*a* is meshed with gear 44, which is integral with splined shaft 46 to provide torque to autocompensating system 19

As is evident from the gears trains, rotation of motor 30 counterclockwise as viewed in FIG. 3 applies a downward torque (as discussed below) to autocompensating system 15 and an upward torque (as discussed below) to autocompensating system 19. Rotation of motor 30 clockwise reverses the direction of torque to both system 15 and system 19.

FIGS. 3 and 4 also illustrate a roller 48, which is mounted to roll free, which drive roller 19*a* contacts when driving should no media sheet 5 be under roller 19*a*, which avoids a high downward torque being generated. With respect to roller 15*a* in the tray 13, no comparable apparatus to roller 48 is used as the high torque can be used to signal absence of paper and therefore to terminate drive to autocompensating system 15.

The autocompensating systems 15 and 19 of this embodiment are not novel with respect to their design and function A slip drive closely similar to that employed has been sold in a prior art device of the assignee of this invention. However, that was employed to lift the paper feed autocompensation system off the paper stack after the top sheet is fed a predetermined distance. This invention employs the slip drive with the autocompensating system located in the paper guide 17.

Figure 5:
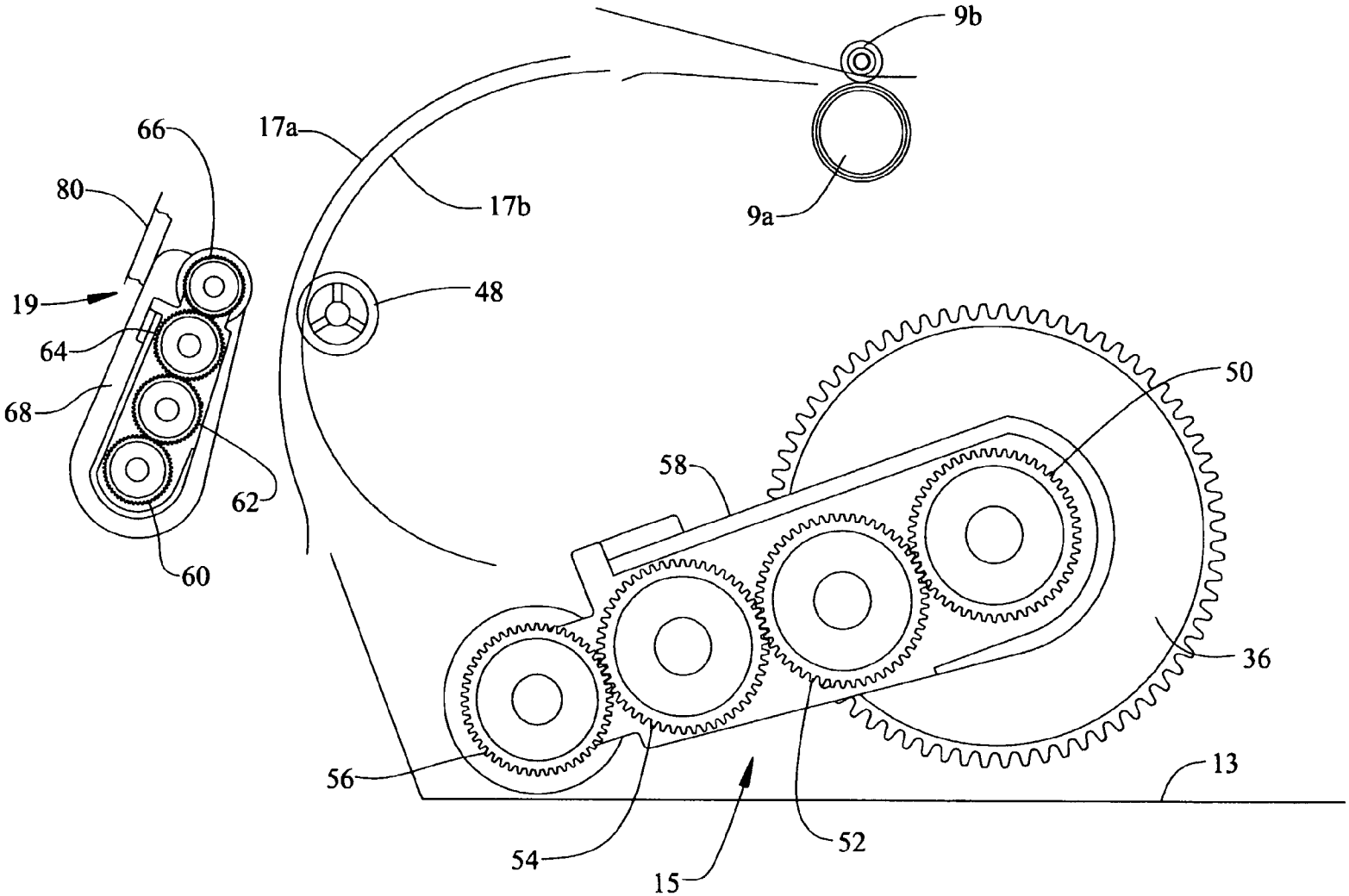
FIG. 5 illustrates the autocompensating systems in some detail and the drive path between tray and nip roller preceding the imaging station.

With reference to FIG. 5, autocompensating system 15 is seen to have four meshed gears 50, 52, 54 and 56 each meshed to the next gear in a linear train and supported within a bracket 58. Gear 56 is integral with drive roller 15*a* so that it moves both by pivoting (when gear 56 pivots) and by rotation (when gear 56 rotates). Gear 50 on the opposite end of the train of gears 50, 53, 54, and 56 is rotated by shaft 38 (FIGS. 2, 3 and 4). Similarly for autocompensating system 19 gears 60, 62, 64 and 66 are each meshed to the next gear in a linear train and supported within a bracket 68. Gear 66 is integral with drive roller 19*a* so that it moves both by pivoting (when gear 66 pivots) and by rotation (when gear 66 rotates).

Assuming counterclockwise torque to gear 50 and clockwise torque to gear 60, so long as gear 56 of system 15 or gear 66 of system 19 is not rotating, the torque pivots bracket 58 or bracket 68 respectively and the force against a sheet 5 of drive roller 15*a* and 19*a* increases toward the maximum pivoting force which can be applied by motor 30. This force is immediately relieved when gear 56 rotates in the case of system 15 and when gear 66 rotated in the case of system 19. Such rotation occurs when a sheet 5 is being moved, and it is the increase in pivot force against the sheet until it is moved which constitutes autocompensating in the systems.

Opposite or no rotation from the feeding rotation of gears 50 and 60 relieve pivoting torque because the direction of pivot is away from the feeding position and therefore the gears 56 and 66 respectively are free to rotate. To prevent such rotation with respect to system 15, gear 50 is driven through a one-way clutch, (not shown), which may be a conventional ball-and-unsymmetrical-notch clutch or other clutch.

Figure 6:
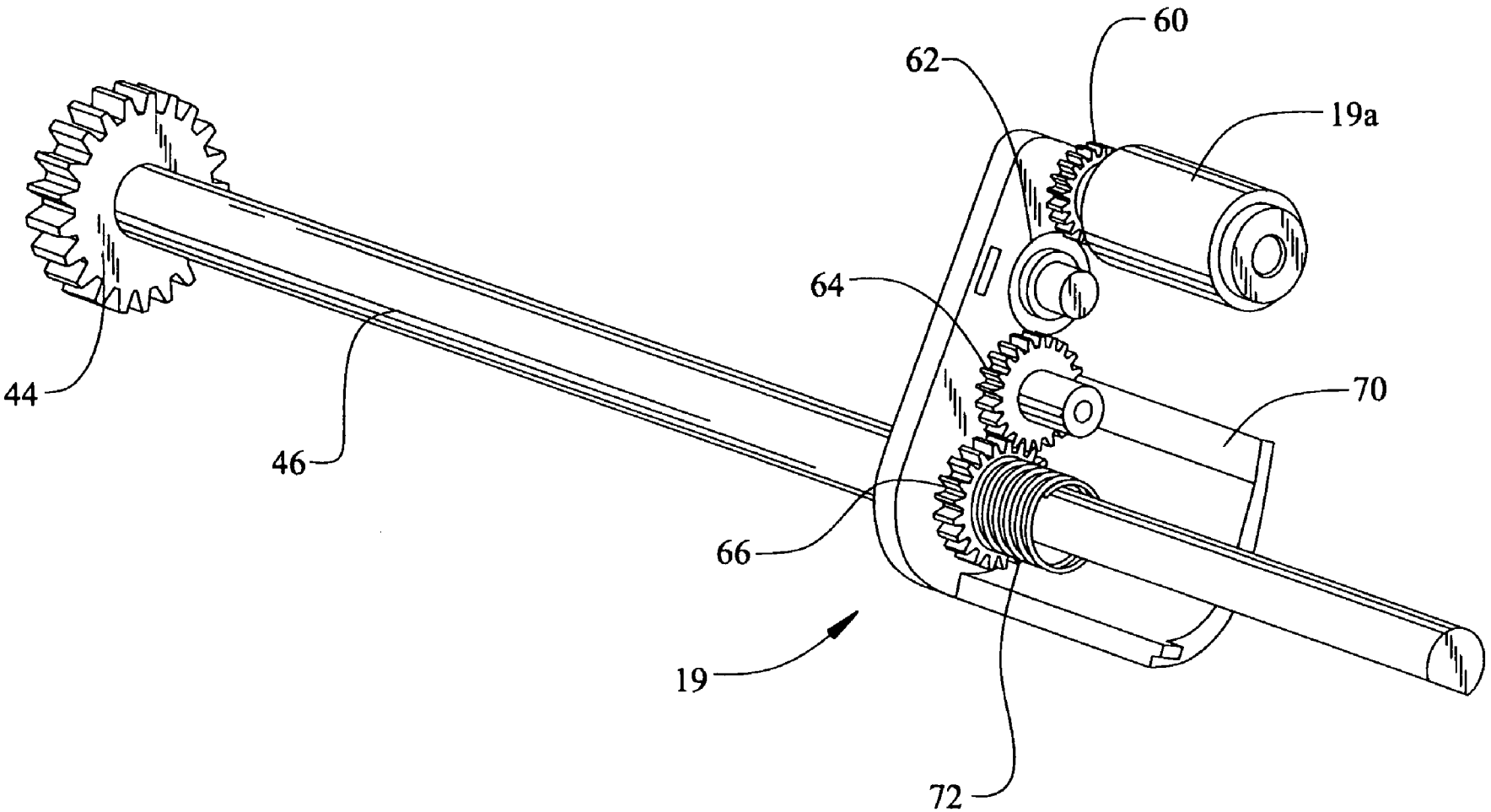
FIG. 6 is a perspective view of selected elements to explain the slip drive.

FIG. 5 shows autocompensation system positively moved away from the guide 17. This occurs when gear 60 is driven in the direction opposite to sheet feed. To achieve that, an added mechanism is applied to the autocompensation system 15, which is illustrated in FIG. 6 and FIG. 7.

This mechanism is a slip drive. As shown in FIG. 6, within the housing 70 of autocompensating system 19 is a coil spring 72 mounted on drive shaft 46 and having one side in contact with the face of gear 66.

Figure 7:
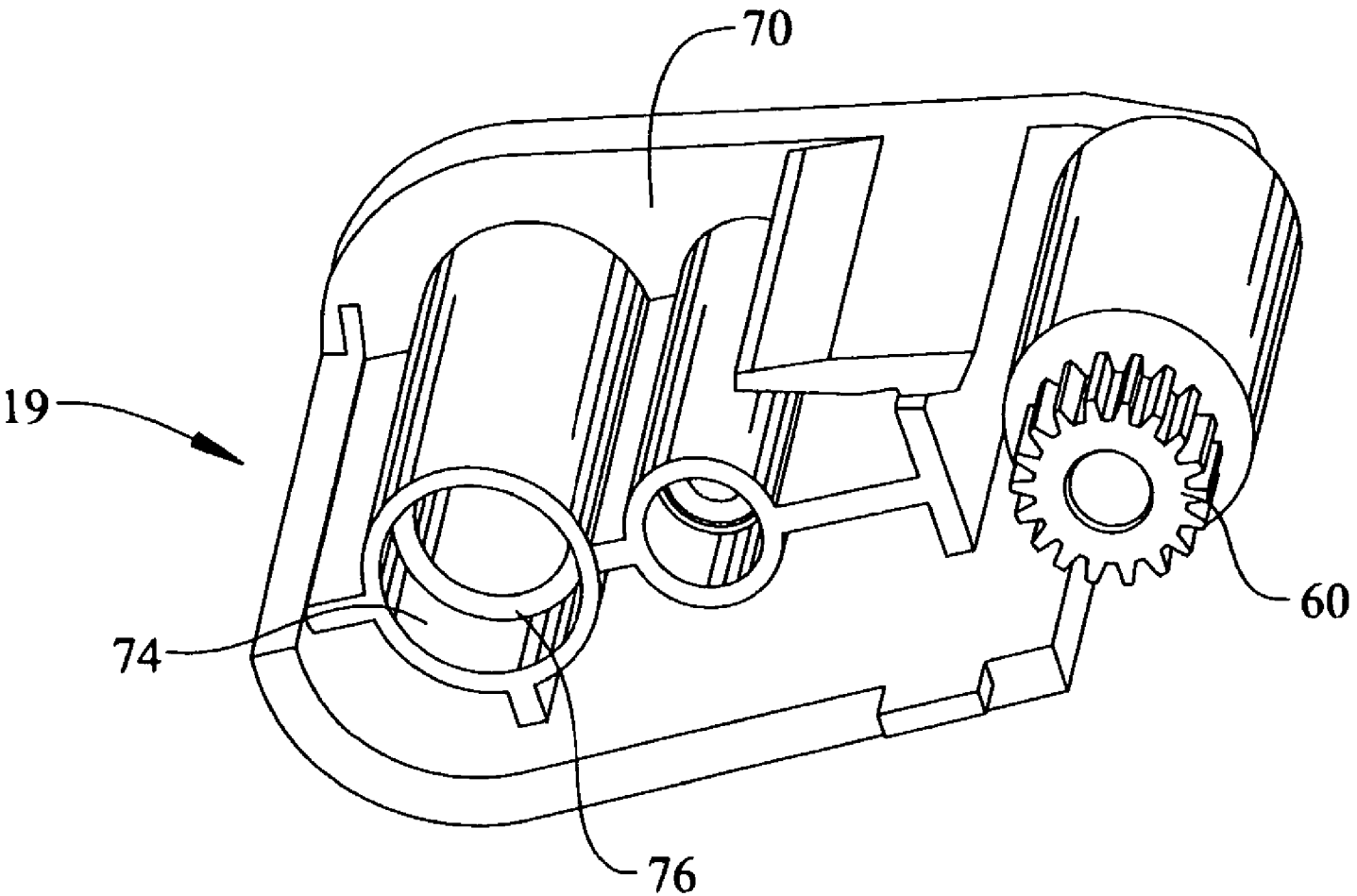
FIG. 7 is a perspective view of selected elements from the side opposite to that of FIG. 6 to explain the slip drive.

As shown in FIG. 7, housing 70 has a cylindrical well 74 with bottom face 76 which receives the side of spring 72 (FIG. 6) opposite to that which faces gear 66. The dimensions of well 74 are such that spring 72 is compressed.

With spring 72 compressed, the turning of gear 66 turns spring 72 and the turning of spring 72 tends to rotate the entire housing 70, since well 74 is integral with housing 70. However, when further rotation is blocked, spring 72 simply slips.

When gear 66 is rotated in the reverse feeding direction, system 19 is moved away from the drive path of guide 17 as shown in FIG. 5, where it is stopped by being blocked by a fixed member 80, which may be integral with the structure forming guide 17.

When gear 66 is rotated in the feeding direction, spring 72 adds somewhat to the downward force while slipping.

In operation, under control of controller C, motor 30 is driven to feed a sheet 5 from tray 13 by rotating autocompensating system 15 downward. Autocompensating system 19 is necessarily driven by the slip drive to move away from the paper feed direction. Accordingly, when a sheet 5 is being moved by system 15, system 19 is moved completely out of guide path 17, as shown in FIG. 4.

In normal operation, the sheet 5 moves to encounter sensor arm 21 (FIG. 1). Then the controller C reverses motor 30. The direction of rotation of motor 30 is reversed, causing autocompensating system 19 to pivot to contact sheet 5, while autocompensating system 15 has no torque since the one-way clutch (not shown), prevents any drive to autocompensating system 15.

System 19 moves sheets 5 until they reach nip roller 9*a*, 9*b* and, preferably, become somewhat buckled. The buckling serves to align sheets 5. The remaining imaging operation may be entirely standard.

It will be recognized that this invention can take many mechanical forms, so long as an autocompensating system is used at least at the intermediate drive location.

What is claimed is:

1. An imaging device comprising an imaging station, a sheet media tray spaced from said imaging station, a C-shaped media guide path between said imaging station and said media tray, said C-shaped media guide path having a curve defining the C-shape, a media drive member to move sheet media from said sheet media tray into said C-shaped media guide path, a pivotally mounted first autocompensating system located in said C-shaped media guide path adjacent to said curve for driving media, said first autocompensating system having a slip drive located within a housing of said first autocompensating system, and a reversing motor to drive said first autocompensating system, whereby said reversing motor drives the sheet media in a first direction away from the sheet media tray to the C-shaped media guide path and said first autocompensating system is driven by the slip drive away from the C-shaped media guide path until rotation of the reversing motor is reversed causing said first autocompensating system to pivot to contact the sheet media and feed the sheet media to the imaging station in a second direction substantially opposite the first direction.

2. The imaging device as in claim 1 wherein said slip drive comprises a spring mounted on a drive shaft contacting a gear whereby turning of the gear turns the spring which rotates the housing of said first autocompensating system until further rotation is blocked and the spring slips.

3. The imaging device as in claim 1 also comprising a second pivotally mounted autocompensating system to feed media from said sheet media tray through said C-shaped media guide path at least to a location at which said first autocompensating system can feed said media whereby said second pivotally mounted autocompensating system is prevented by a clutch from receiving any power from said motor.

4. The imaging device as in claim 3 wherein said motor also drives said second autocompensating system.

5. An imaging device comprising an imaging station, a sheet media tray spaced from said imaging station, a C-shaped media guide path between said imaging station and said media tray, said C-shaped media guide path having a curve defining the C-shape, a pivotally mounted first autocompensating system mounted in an intermediate position in said C-shaped media guide path adjacent to said curve for driving sheet media to said imaging station, said first autocompensating system having a slip drive located within a housing of said first autocompensating system, a pivotally mounted second autocompensating system to pick sheet media from said sheet media tray and feed said sheet media through said C-shaped media guide path at least to a location at which said first autocompensating system can feed said sheet media, and a reversing motor to drive said first autocompensating system while operating in reverse mode and said second autocompensating system while operating in forward mode, whereby said reversing motor drives the sheet media in a first direction away from the sheet media tray to the C-shaped media guide path by rotating said second autocompensating system downward while said first autocompensating system is driven by the slip drive away from the media guide path until a media-presence sensor detects the sheet media which reverses the direction of the motor causing the first autocompensating system to contact the sheet media and feed the sheet media in a second direction substantially opposite to the first direction to the imaging station while said second autocompensating system is prevented by a clutch from receiving any power from said motor.

6. The imaging device as in claim 5 wherein said slip drive comprises a spring mounted on a drive shaft contacting a gear whereby turning of the gear turns the spring which rotates the housing of the first autocompensating system until further rotation is blocked and the spring slips.

* * * * *